US011503696B2

(12) United States Patent
Abramenko et al.

(10) Patent No.: US 11,503,696 B2
(45) Date of Patent: Nov. 15, 2022

(54) BROADBAND LASER-PUMPED PLASMA LIGHT SOURCE

(71) Applicants: RnD-ISAN, Ltd, Moscow (RU); ISTEQ B.V., Eindhoven (NL)

(72) Inventors: Dmitriy Borisovich Abramenko, Moscow (RU); Yurii Borisovich Kiryukhin, Moscow (RU); Denis Alexandrovich Glushkov, Nieuwegein (NL); Vladimir Mikhailovich Krivtsun, Moscow (RU); Aleksandr Andreevich Lash, Moscow (RU)

(73) Assignees: RnD-ISAN, Ltd, Moscow (RU); Isteq B.V., Eindhoven (NL)

( * ) Notice: Subject to any disclaimer, the term of this patent is extended or adjusted under 35 U.S.C. 154(b) by 0 days.

(21) Appl. No.: 17/514,178

(22) Filed: Oct. 29, 2021

(65) Prior Publication Data

US 2022/0053627 A1 Feb. 17, 2022

Related U.S. Application Data

(63) Continuation-in-part of application No. 17/180,063, filed on Feb. 19, 2021, now Pat. No. 11,191,147, which is a continuation-in-part of application No. 16/986,424, filed on Aug. 6, 2020, now Pat. No. 10,964,523, which is a continuation-in-part of application No. 16/814,317, filed on Mar. 10, 2020, now Pat. No. 10,770,282.

(30) Foreign Application Priority Data

Mar. 5, 2020 (RU) ..... 2020109782
Oct. 8, 2021 (RU) ..... 2021129398

(51) Int. Cl.
*H05G 2/00* (2006.01)

(52) U.S. Cl.
CPC ..... *H05G 2/008* (2013.01)

(58) Field of Classification Search
CPC ..... H05H 1/24; H05G 2/008
See application file for complete search history.

(56) References Cited

U.S. PATENT DOCUMENTS 5,379,315 A * 1/1995 Meinzer ..... H01S 3/223 372/101
6,331,993 B1 * 12/2001 Brown ..... H01S 3/09415 372/71

* cited by examiner

*Primary Examiner* — Anne M Hines
(74) *Attorney, Agent, or Firm* — Nadya Reingand

(57) ABSTRACT

A light source with radiating plasma sustained in the gas-filled chamber by a focused beam of CW laser. The gas is inert gas with a purity of at least 99.99%. The chamber contains a metal housing with at least one window made of $MgF_2$ for outputting a plasma radiation. Each window is located in a hole of the housing on the end of a sleeve and is soldered to the sleeve by means of glass cement, and each sleeve is welded to the hole of the metal housing on the outside seam. The sleeves and the housing are made of an alloy with a coefficient of linear thermal expansion (CLTE), matched with the CLTE of the $MgF_2$ crystal in the direction perpendicular to the optical axis of the $MgF_2$ crystal. The technical result consists in expanding the radiation spectrum of the light source into the VUV region.

20 Claims, 5 Drawing Sheets

BROADBAND LASER-PUMPED PLASMA LIGHT SOURCE

CROSS-REFERENCE TO RELATED PATENTS AND APPLICATIONS

This patent application is a Continuation-in-part of the U.S. patent application Ser. No. 17/180,063 filed Feb. 19, 2021, currently allowed, which claims priority to Russian patent application No. RU2020109782 filed Mar. 5, 2020 and also which is a Continuation-in-part of the U.S. application Ser. No. 16/986,424 filed Aug. 6, 2020, currently U.S. Pat. No. 10,964,523, which is a Continuation-in-part of the U.S. application Ser. No. 16/814,317 filed Mar. 10, 2020, currently U.S. Pat. No. 10,770,282, and also it claims priority to Russian patent application RU2021129398 filed on Oct. 8, 2021, all of which are incorporated herein by reference in their entirety.

TECHNICAL FIELD

The invention relates to high-brightness broadband light sources with continuous optical discharge, to the gas-filled chamber used therein and to the method of its manufacture.

BACKGROUND OF INVENTION

A stationary gas discharge sustained by laser radiation in pre-created relatively dense plasma is known as continuous optical discharge (COD).

A COD, sustained in the gas-filled chamber by a focused beam of a continuous wave (CW) laser, is realized in various gases, in particular, in Xe at a high gas pressure of up to 200 atm (Carlhoff et al., "Continuous Optical Discharges at Very High Pressure," Physica 103C, 1981, pp. 439-447). COD-based light sources with a plasma temperature of about 20,000 K (Raizer, "Optical discharges" Sov. Phys. Usp. 23 (11), November 1980, pp. 789-806) are among the highest brightness continuous light sources in a wide spectral range from the vacuum ultraviolet (VUV) to the near-infrared.

One of the challenges related to creation of high-brightness COD-based light sources relates to increasing the output of vacuum ultraviolet radiation which, in particular, results in special requirements to short-wave boundary λb and to transparency of optical materials used for outputting the COD plasma broadband radiation from the chamber.

As known from patent application JP2006010675, published on Dec. 1, 2006, a high optical output in the VUV range is achieved in an optical discharge when the purity of inert gas in the chamber is at least 99.99%. At the same time, the short-wave boundary of the light source radiation spectrum is determined by the material of the chamber exit window, for which lithium fluoride (LiF), magnesium fluoride (MgF2), calcium fluoride (CaF2), sapphire (Al2O3) or quartz (SiO2) can be used.

Among these materials, LiF и MgF2 have the shortest-wave boundary of transparency, around 110 nm. Further, among the latter two, MgF2 is the material with better mechanical and thermal properties, as well as producibility, therefore its use is preferable for expanding the radiation spectrum as far as 100 nm in the VUV range.

The device described in patent application JP2006010675 used pulsed-mode excitation of the optical discharge, therefore the drawbacks of the device consisted in low average power and brightness of the light source. In pulsed mode of optical discharge excitation, the optimum pressure in the chamber is around 1 atm, while the chamber temperature is close to room temperature, which eliminates the issues with sealing the exit window made of any of the above-mentioned optical materials. However, the situation is radically different for high-brightness plasma radiation sources with continuous optical discharge.

As known, for example, from patent U.S. Ser. No. 10/964,523, published on Mar. 30, 2021, and incorporated herein by reference, the optimum continuous generation of COD plasma radiation, characterized by a spectral brightness of over 50 mW/(mm$^2$ nm sr) and a relative brightness instability σ of less than 0.1%, is achieved by preferably having the highest possible operating temperature of the chamber internal surface, 600 to 900 K or higher, at an optimum gas pressure in the chamber above 50 atm or higher, while the chamber walls are located from the region of radiating plasma at a distance of less than 5 mm, preferably no more than 3 mm. The sealed-off bulbs made of fused quartz and used as the chamber meet these criteria at least partially.

However, the transparency boundary of quartz, λb≈170 nm, is inferior to other optical materials mentioned above, in particular, MgF2 (λb≈110 nm). At the same time, the option of replacing the bulb material with MgF2 is challenging due to its mechanical properties, while using MgF2 windows is also problematic due to the difficulty of their sealing at high temperatures and pressures.

To raise the chamber's operating temperature, in patent U.S. Pat. No. 10,109,473, published on Oct. 23, 2018, it was proposed to mechanically seal the chamber windows using C-rings made of an elastic metal such as steel.

However, this solution mainly relates to using sapphire windows with λb≈145 nm. The application of MgF2 windows with this type of seal is problematic due to their insufficient mechanical strength.

In U.S. Pat. No. 10,609,804 published on May 31, 2020 the laser-pumped plasma light source comprises a gas-filled chamber with a metal column-shaped housing which consists of two housing parts and with coaxial inlet and exit windows sealingly installed on the housing ends. Each window, whose side cylindrical surface is nickel-plated, is positioned inside a circular nickel-plated kovar sleeve and soldered to the sleeve's internal surface using Ag solder. Further, each circular sleeve with the window soldered to it is soldered or welded to one of the housing parts on the outside seam. After the internal chamber parts (an ellipsoid mirror and a laser radiation blocker) are installed, the housing parts with the mounted windows are welded together. After welding, the housing is vacuumed and filled with gas through a nozzle which is welded or sealed under pressure. The coefficient of linear thermal expansion (CLTE) of the kovar sleeve which the window is soldered to, is matched with the CLTE of sapphire, hence the chamber suggests using sapphire windows.

As compared to typically used quartz bulbs (λb≈170 nm), the said light source is characterized by a broader spectrum of radiation in the VUV range, if sapphire windows are used (λb≈145 nm). Besides, it features a stronger chamber which allows to increase the power of laser pumping and, consequently, raise the power of output radiation, including in the UV and VUV ranges.

However, in the plasma light source of this type, further expansion of the VUV spectrum is limited due to the difficulty of applying MgF2 windows therein. The CLTE of an MgF2 crystal is significantly different in the optical axis direction and in the direction perpendicular to the optical axis, and equals, correspondingly, to $13{\cdot}7{\cdot}10^{-6}/K$ and $8{\cdot}48{\cdot}10^{-6}/K$. Consequently, the seal of the connection between the isotropic metal circular sleeve and the anisotropic MgF2 crystal soldered in it is unreliable when the chamber is heated to 600-900 K, which is necessary for optimally generating radiation from continuous optical discharge plasma. The unreliability of this sealing comes from the fact that the CLTE of metal solders ($\sim 20{\cdot}10^{-6}/K$) is also significantly different from the CLTE of MgF2. Also, the pressure of gas on the window contributes to the shift and rupture of the sealed joint, thereby decreasing its reliability. Expanding the spectrum of similar plasma light sources in the VUV range produces little effect also due to the fact that the plasma radiation beam is formed only by reflection of the plasma radiation by the metal mirror inside the chamber. The coefficient of reflection for a metal mirror is low in the VUV range (~20% at the wavelength of 110 nm for aluminum). The presence of an intrachamber mirror results in locating the lens focusing the CW laser beam outside the chamber housing. This limits the focusing sharpness of the CW laser beam and reduces the light source brightness. Also, the presence of a mirror does not allow for minimizing the dimensions of intrachamber space to suppress convective flows which results in instability of the exiting radiation power. A drawback of the said design also consists in the propagation of the laser radiation beam in the exit window direction, which requires taking special measures for its blocking.

INVENTION DISCLOSURE

Accordingly, there is a need for creation of higher-brightness and highly stable light sources with a broader radiation spectrum in the VUV range, which are free from the drawbacks mentioned above.

The technical problem and the technical result of the invention consist in expanding the radiation spectrum of laser-pumped plasma light sources in the VUV range while providing for high brightness and stability of their broadband radiation.

The invention essentially consists in using a high-technology optical material with the minimum boundary of transparency ($\lambda b \approx 110$ nm), namely, MgF2 as material of the window for outputting the beam of plasma radiation from the chamber. This allows for expanding the radiation spectrum of laser-pumped plasma light sources in the VUV range.

The gas in the chamber belongs to inert gases with a purity of at least 99.99% in order to eliminate the self-absorption of VUV radiation by impurities.

The crystalline magnesium fluoride is anisotropic and is characterized by weak double refraction. According to the invention, to eliminate the double refraction of the beam of radiating plasma, the surface of the end of the axisymmetric sleeve and the surface of the MgF2 exit window adjacent to it are essentially perpendicular to the optical axis of the MgF2 crystal.

The possibility of operating at high temperatures, at least 600 K, and pressures of around 50 atm and higher, in order to provide for high brightness and stability of the light source, is achieved by sealing the chamber windows by means of their soldering with glass cement. According to the invention, the process of glass cement soldering involves the application of single-stage annealing of the joint at a temperature of at least 400° C., which results in the possibility of operating the joint at temperatures of up to 900 K. The window is soldered to the separate metal part of the housing designed as a sleeve. After annealing, the metal parts of the chamber housing are joined together by welding in a manner which does not expose the sealed joint to another annealing, capable of reducing the sealed joint reliability.

To provide for highly reliable sealing of the MgF2 exit window, the sleeve and housing are made of iron-nickel alloy with a predefined CLTE, matched with the CLTE of the crystal magnesium fluoride in the direction perpendicular to the optical axis of the crystal, such as 47 ND alloy.

To prevent window cracking caused by their irregular cooling, instead of soldering on complex-shaped housing parts of the chamber, the windows are soldered on the ends of axisymmetric metal sleeves around 1 cm long or longer. Soldering is performed with the sealed joint components having matched coefficients of linear thermal expansion (CLTE) arranged in the optimum manner in terms of the force of gravity. Then the sleeves with the soldered windows are welded to the housing on the outside seam. In another embodiment the sleeves with the soldered windows are welded to the housing parts, and the housing is permanently welded together after the internal chamber elements have been mounted. At the same time, the axisymmetric sleeves cancel out the irregularity of heating and cooling of the assembled chamber structure.

According to the invention, the windows are installed on the inside of the gas-filled chamber. On the one hand, it improves the seal reliability due to the high pressure of gas in the chamber which compresses the sealing elements. On the other hand, the possibility is realized to manufacture a chamber with optimally minimized dimensions, when the chamber walls, including its optical elements, are located at a distance of less than 5 mm from the region of radiating plasma. This suppresses the turbulence of convective flows in the chamber and provides for high stability of the radiation source.

The internal chamber elements include the lens which focuses the CW laser beam. The focusing lens preferably has an aspherical design, and is located between the inlet window and the region of radiating plasma, which, due to the sharpest possible focusing of the CW laser beam, improves the brightness of the light source. For the same purpose, at least one retroreflector, for example, in the form of a spherical mirror with the center in the radiating plasma region, can be placed in the chamber, located opposite the exit window and/or on the axis of the focused laser beam. The exit window can also be a lens designed with the function of reducing aberrations which distort the path of beams of plasma radiation passing through the exit window, and/or with the function of reducing the angular aperture of the exiting plasma radiation beam.

To prevent the generation of ozone and absorption of the beam of plasma radiation, a vacuum or gas environment, which does not absorb VUV radiation with the wavelength of 110 nm and higher, can be located outside the MgF2 exit window. With this purpose, in an embodiment of invention, the chamber can be sealingly connected to an outside chamber with objects which the beam of plasma radiation is carried to, filled with a vacuum or gas environment which does not absorb the plasma radiation exiting the chamber through the MgF2 window. As the optimum temperature may be high, 600 K and more, the chamber can be sealingly connected to the outside chamber by means of a branch pipe made with the function of a thermal bridge between the chamber and the outside chamber. Besides, the branch pipe can be equipped with a cooling radiator to prevent heating of the outside chamber.

Other aspects of the invention are aimed at further increasing brightness and stability of the laser-pumped plasma radiation source, as well as at improving its performance.

The above-mentioned and other objectives, advantages and features of this invention will be made more evident in the following non-limiting description of its embodiments, provided as example with reference to attached drawings.

BRIEF DESCRIPTION OF FIGURES

The essence of invention is explained by drawings wherein.

Identical device elements are designated by the same reference numbers on the drawings.

These drawings do not cover and, moreover, do not limit the entire scope of embodiments of this technical solution, but are only illustrative examples of particular cases of implementation thereof.

EMBODIMENTS OF INVENTION

Figure 1:
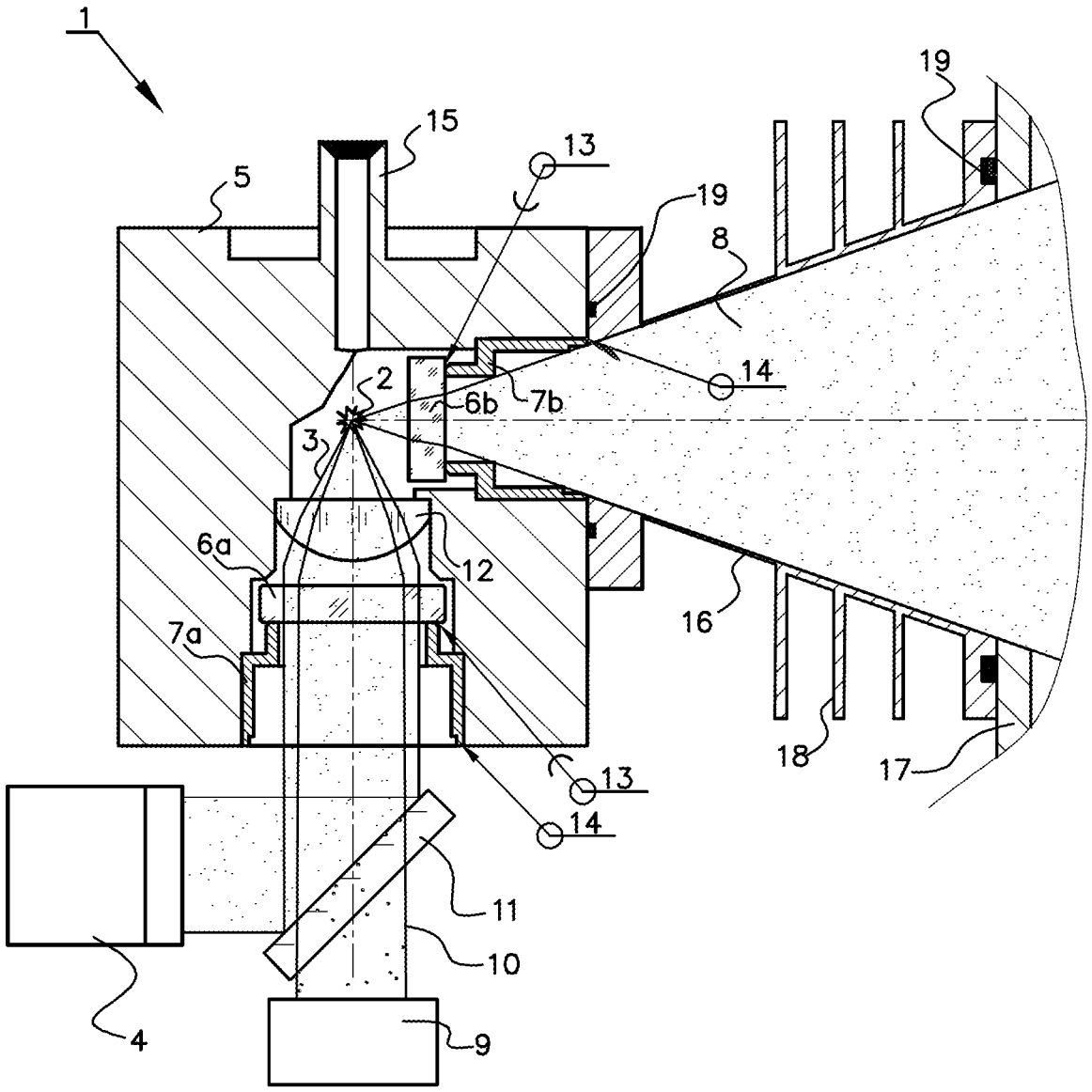
FIG. 1, FIG. 2—cross-section of the broadband laser-pumped light source according to embodiments of this invention.

According to the example of invention embodiment shown in FIG. 1, the broadband laser-pumped light source comprises a chamber 1 filled with gas at high pressure, with a region of radiating plasma 2 sustained in the chamber by a focused beam 3 of a continuous wave (CW) laser 4. The chamber 1 contains a metal housing 5 comprising a window 6*a* for introducing the CW laser beam into the chamber and at least one window 6*b* for outputting a plasma radiation beam 8 intended for subsequent use from the chamber.

The light source also contains a means for starting plasma ignition. As the means for plasma ignition a pulsed laser system 9 can be used generating at least one pulsed laser beam 10 focused in the chamber region designed for sustenance of the radiating plasma 2. In other embodiments of invention, igniting electrodes can be used as the means for plasma ignition.

According to the invention, the CW laser beam can be directed into the chamber by means of a dichroic mirror 11 and focused by means of a lens 12 placed in the chamber between the window 6*a* and the region of radiating plasma 2, which provides for sharper focusing of the CW laser beam and thereby increases the light source brightness. The lens 12 can be simultaneously used to focus the pulsed laser beam 10 at the time of starting plasma ignition.

The light source brightness is increased by ensuring the sharpest possible focus of the CW laser beam using an optical system which comprises the window 6*a* and the focusing lens 12, preferably with an aspherical design, in order to minimize total aberrations of the said optical system. The focusing lens 12 is preferably positioned at the smallest possible distance from the region of radiating plasma 2, the distance not exceeding 5 mm. In order to facilitate the chamber design, the window 6*a* can be made using a simple manufacturing technique, for example, in the shape of a plate or lens with a spherical surface. The aspherical lens 12 can be made of glass or quartz to facilitate its manufacturing.

At least one window 6*b* for outputting the beam of plasma radiation 8 from the chamber is made of crystal magnesium fluoride (MgF2). MgF2 is characterized by high producibility and, at the same time, has the shortest-wave boundary of transparency among the optical materials. Accordingly, the short-wave boundary of the spectrum in the beam of plasma radiation exiting the chamber is determined by the MgF2 transmission limit in the vacuum ultraviolet (VUV) region, which is approximately 110 nm. Further, the gas belongs to inert gases with a purity of at least 99.99% or is a mixture thereof in order to eliminate the self-absorption of VUV radiation by gas impurities. This allows expanding the radiation spectrum of the light source into the vacuum ultraviolet region.

In FIG. 1 the beam of plasma radiation 8 is directed from the region of radiating plasma 2 into the window 6*b* made of MgF2 straight and without reflections. In contrast to sources where the beam of plasma radiation is formed by an intra-chamber metal mirror, whose coefficient of reflection is low in the VUV range (less than 20% at $\lambda$=110 nm), this ensures the absence of a cut-off or suppression of the VUV component in the spectrum of the beam of plasma radiation.

Each of the windows 6*a*, 6*b* is located on the inside of the chamber on the end of one of the sleeves 7*a*, 7*b* closest to the region of radiating plasma 2. Each of the windows 6*a*, 6*b* is soldered to one of the sleeves 7*a*, 7*b* using glass cement 13. The windows soldering performed in the process of annealing ensures the possibility of operating the sealed joint and the chamber assembly at temperatures of up to 900 K which is optimal for achieving high brightness and stability of the light source.

Each of the sleeves 7*a*, 7*b* with the soldered window 6*a*, 6*b* is positioned in one of the holes in the housing 5 and is welded into the hole of the housing 5 on the outside welding seams 14. Further, the internal parts of the axisymmetric sleeves 6*a*, 6*b* are the external part of the chamber which is not in contact with the gas it is filled with. Along with the placement of windows on the chamber inside, this improves reliability of the sealed joint due to the high pressure of gas in the chamber which compresses the sealing material (glass cement 13) and facilitates the sealing of optical elements.

According to the invention, the surface of the end of sleeve 7*b* and the surface of the MgF2 exit window 6*b* adjacent to it are essentially perpendicular to the optical axis of the MgF2 crystal. The coefficients of linear thermal expansion (CLTE) of the glass cement 13, material of the sleeves 7*a*, 7*b* and the housing 5 are matched with the CLTE of the crystal magnesium fluoride in the direction perpendicular to the optical axis of the MgF2 crystal. All of the mentioned above provides for high reliability and longer lifetime of the windows and the chamber assembly. Preferably, the sleeves and the chamber housing are made of the 47 ND iron-nickel alloy which meets these requirements.

The chamber 1 is filled with high-pressure gas either through a soldered welded tubulation or through a gas port 15 designed to control the pressure and/or composition of gas in the chamber.

Thus, the present invention provides for manufacturing highly reliable chambers with MgF2 windows to operate at high pressures (around 50 atm) and temperatures (around 900° K) and for creating brighter and more stable COD-based light sources with the broadest spectrum of radiation in the VUV range.

According to an embodiment of invention shown in FIG. 1, a vacuum or gas environment, such as helium, argon, etc., which does not absorb VUV radiation with wavelengths of 110 nm and higher, is located outside the MgF2 exit window 6*b* intended for outputting the beam of plasma radiation 8 from the chamber. For this purpose the chamber 1 can be sealingly connected to an outside chamber 17 with objects which the beam of plasma radiation 8 is carried to, by means of a branch pipe 16.

In this case the beam is carried without generation of ozone and without losses of the VUV component of plasma radiation.

High stability and high brightness of the radiating plasma in the continuous mode of operation is achieved when the pressure of gas in the chamber is around 50 atm or higher, while the chamber temperature is around 600 K or higher. Due to the high temperature of the chamber 1 the branch pipe 16 is designed with the function of a thermal bridge between the chamber 1 and the outside chamber 17. For this purpose at least a part of the branch pipe 16 is made with a low thermal conductivity, for example, of thin stainless steel. In order to cool the part of branch 16 removed from the window 6*b*, it is designed as a cooling radiator 18 which prevents heating of the outside chamber 17. The sealed joint of the branch pipe 16 to the chamber 1 and the outside chamber 17 can be provided using sealing gaskets 19 which can be made of copper, at least, on the side of the heated chamber 1.

In the embodiment of invention, FIG. 1, all the axisymmetric sleeves 7*a*, 7*b* with the windows 6*a*, 6*b* soldered to them, are welded to the single common housing part 5. Further, the region of radiating plasma 2 is positioned in the cavity of housing 5 formed by the intersection of at least two holes, in each of which one of the sleeves 7*a*, 7*b* with one of the windows 6*a*, 6*b* is located. The sleeves 7*a*, 7*b* have a variable outside diameter, while the windows 6*a*, 6*b* are located on the end of sleeves with the smaller outside diameter.

The broadband laser-pumped light source is operated as described below. First, the chamber 1 of the light source is manufactured, comprising the metal housing 5, with at least two windows 6, 6*b*, FIG. 1. At least one window 6*b* is made of MgF2. The material of at least one of the windows 6*a* can be glass with a CLTE matched with the CLTE of MgF2. The chamber housing is manufactured from the 47 ND precision alloy with a CLTE also matched with the CLTE of MgF2. Each of the windows 6*a*, 6*b*, is soldered to one of the sleeves 7*a*, 7*b*, using glass cement 13 with the application of annealing at the temperature of at least 400° C. Each sleeve with the window soldered to it is welded into the hole of metal housing 5. The chamber is filled with gas at high pressure either through the sealed tubulation or through the gas port 15.

Broadband radiation of COD plasma is generated as described below. The focused beam 3 of the CW laser 4 is directed into the region 2 of the chamber intended for sustaining the radiating plasma. Preferably, inert gases of high purity and mixtures thereof are used as the gas. By means of the pulsed laser system 9 at least one pulsed laser beam 10 is generated. The beam of CW laser and the pulsed laser beam are introduced into the chamber 1 through the window 6*a*. At the same time, the optical system comprising the window 6*a* and the focusing lens 12 provides for sharp focusing of the laser beams. The pulsed laser system 9 is used to provide the optical breakdown and to generate the starting plasma with a density which exceeds the threshold density of COD plasma having a value of around $10^{18}$ electrons/cm3. The concentration and volume of the starting plasma are sufficient for reliable sustenance of a continuous optical discharge by the focused beam of CW laser 3 with a relatively low power not exceeding 300 W. In stationary mode broadband high-brightness radiation is output from the region of radiating plasma 2 of the continuous optical discharge using at least one beam 8 of plasma radiation. The short-wave boundary of the spectrum of plasma radiation exiting the chamber is determined by the MgF2 transmission limit which is approximately 110 nm. The beam 8 exiting the chamber through the MgF2 exit window 7*b* is intended for subsequent use, for example, in the outside chamber 17. The chamber 1 can be sealingly connected to the outside chamber 17 filled with a vacuum or gas environment which does not absorb the VUV radiation exiting the chamber 1. In working mode the temperature of chamber 1 is preferably around 600 K or higher. Further, thermal isolation between the chamber 1 and the external chamber 17 is provided by means of the branch pipe 17 which is designed with the thermal bridge function and equipped with the cooling radiator 19.

Figure 2:
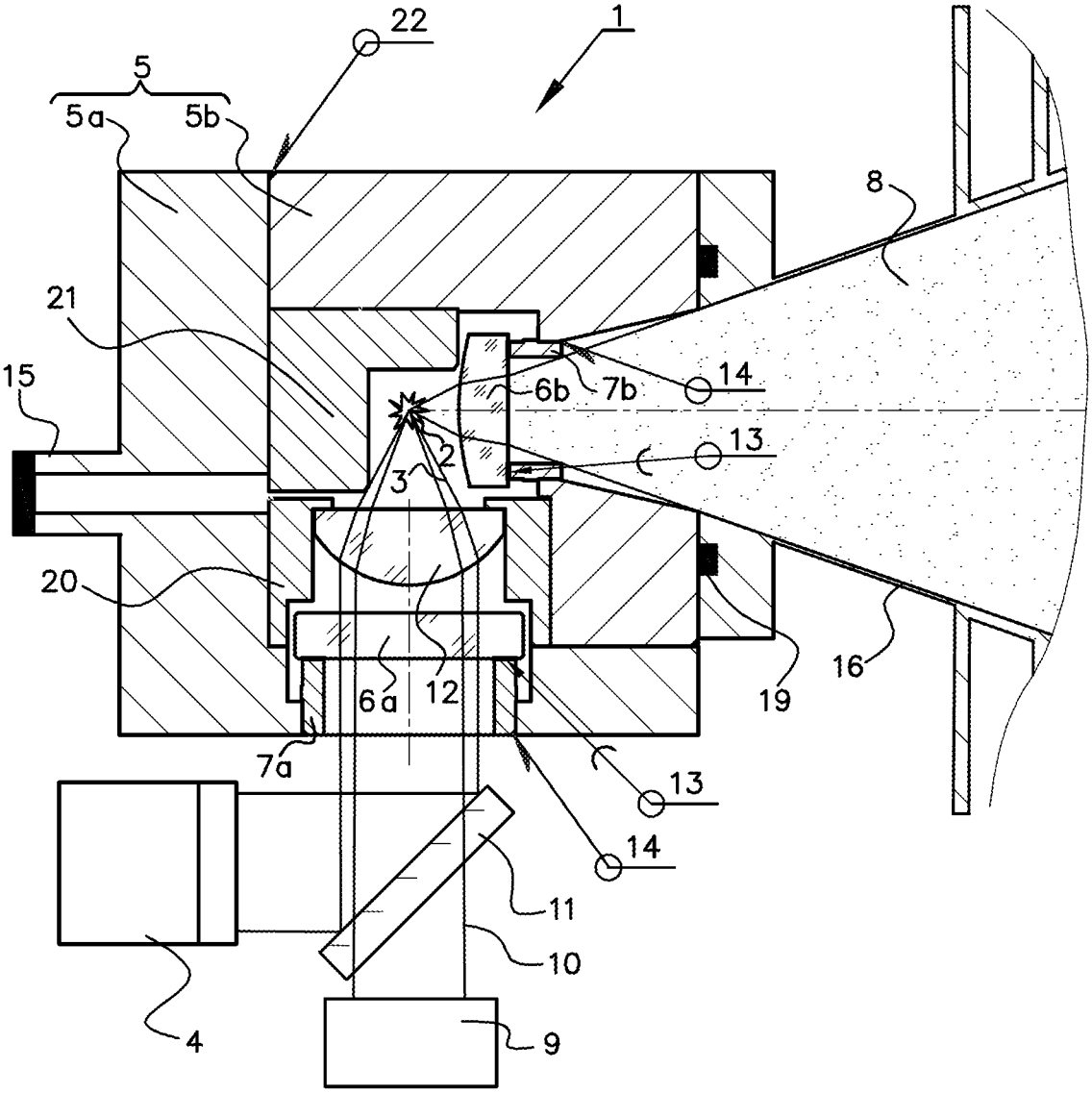

In the embodiment of invention shown in FIG. 2 the chamber 1 contains the welded metal housing 5 comprising at least two housing parts 5*a*, 5*b*, to each of which the sleeve 7*a*, 7*b* is welded with the window 6*a*, 6*b* soldered to it.

After the internal chamber elements, which include the focusing lens 12 with a mounting or casing 20 and an insert 21, are installed, the housing parts 5*a*, 5*b* with the windows 6*a*, 6*b* are welded together with a welding seam 22. During the welding of housing parts 5*a*, 5*b* the axisymmetric sleeves 7*a*, 7*b* welded to them with the windows 6*a*, 6*b* cancel out the irregular heating and cooling of the assembled chamber 1.

Figure 3:
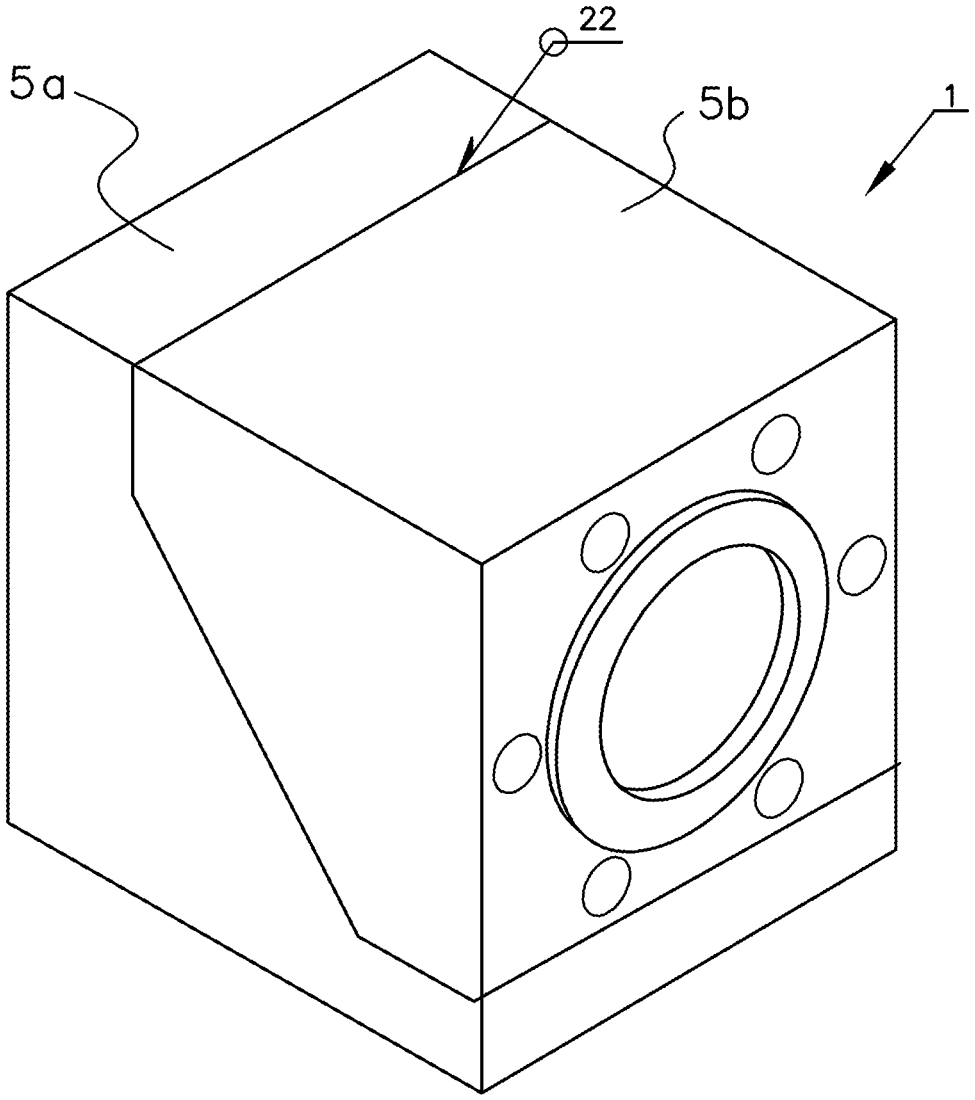
FIG. 3—external view of the broadband laser-pumped light source.

The external view of the welded housing of the light source is schematically shown in FIG. 3.

To simplify the chamber design, the welds 14, 22 are located on the external surface of housing 5.

Figure 4:
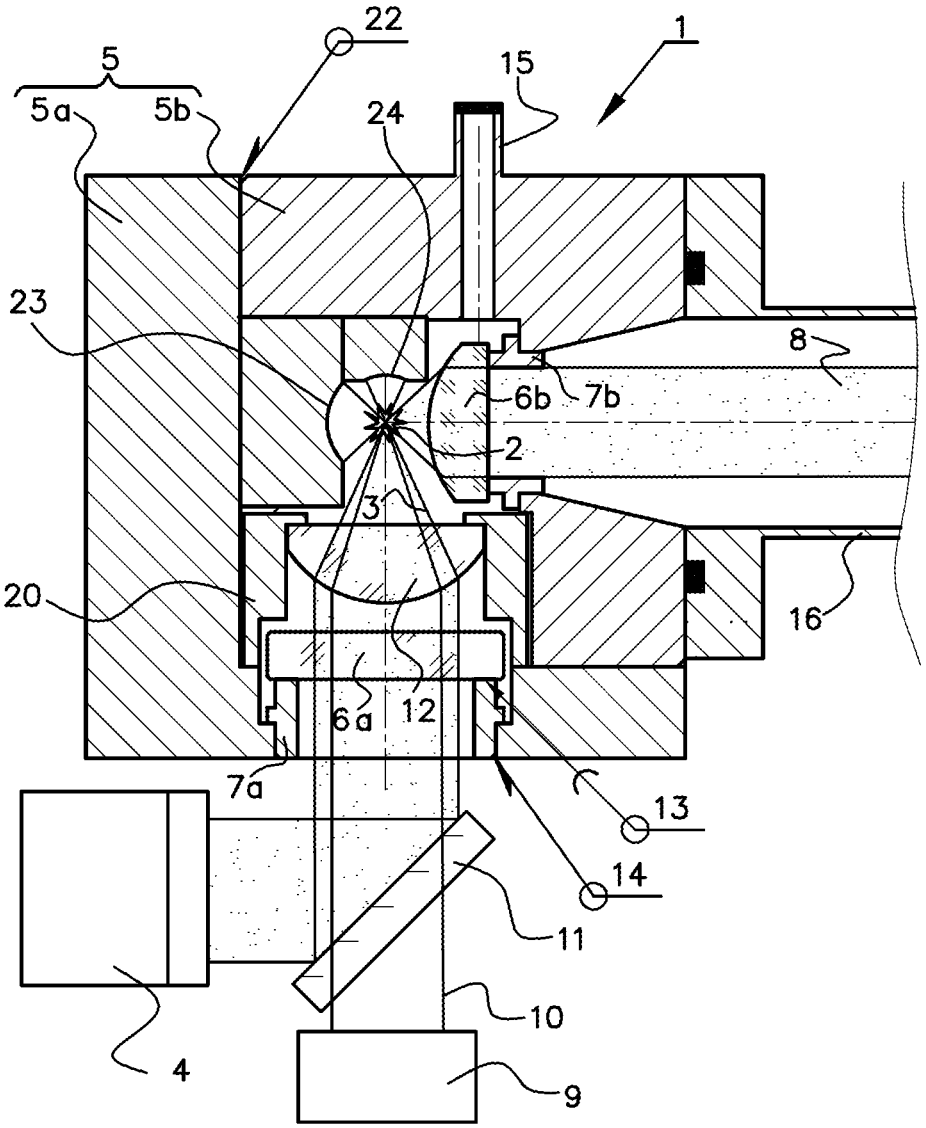
FIG. 4, FIG. 5—diagram of the broadband laser-pumped light source according to embodiments of this invention.

In FIG. 4 another embodiment is schematically shown where the MgF2 window 6*b* for outputting the beam of plasma radiation 8 from the chamber is a lens designed with the function of reducing the angular aperture of the beam of plasma radiation or reducing the aberrations which distort the path of rays of plasma radiation when they pass through the window 6*b*. Generally, the window 6*b* is designed as a meniscus or another type of matching lens. This increases the brightness of radiation source, minimizes the dimensions of light source and improves its ease of operation.

For the similar purpose of increasing light source brightness, retroreflectors 23, 24 designed as spherical mirrors with the center in the region of radiating plasma 2 are placed in the light source chamber, FIG. 4. The retroreflectors 23 and 24 are positioned opposite the MgF2 window 6*b* and on the axis of the focused laser beam 3.

To eliminate the undesirable presence of CW laser radiation in the beam of plasma radiation, the direction of the beam of plasma radiation 8 is different from the direction of the beam of CW laser 3 having passed through the region of radiating plasma 2. This prerequisite is easily implemented in the design of chamber 1 the housing of which, as shown in FIG. 1, FIG. 2, FIG. 3, FIG. 4 is designed as a cube or rectangular prism, in which case the focused beam of CW laser 3 and each beam of plasma radiation 8 are located on mutually orthogonal axes which intersect in the region of radiating plasma 2.

In the preferred embodiments of invention, the axis of the focused beam of CW laser 3 is directed vertically upwards, i.e. against the force of gravity, FIG. 1, FIG. 2, FIG. 4, or close to vertical. The proposed design achieves the highest stability of the power of laser-pumped light source radiation. This is due to the fact that typically the region of radiating plasma 2 is slightly shifted from the focal point towards the focused beam 3 of CW laser up to the cross-section of focused laser beam where the intensity of the focused beam 3 of CW laser is still sufficient to sustain the region of radiating plasma 2. When the focused beam 3 of CW laser is directed from the bottom upwards, the region of radiating plasma 2 that contains the hottest plasma with the lowest mass density, tends to float under the influence of the buoyant force. The rising region of radiating plasma 2 ends up in the location closest to the focal point where the cross-section of the focused beam 3 of CW laser is smaller, and the laser radiation intensity is higher. On the one hand, this increases the brightness of plasma radiation, and on the other hand, it equalizes the forces acting on the region of radiating plasma, which ensures high stability of radiation power of the high-brightness laser-pumped light source.

The stability of output characteristics of the laser-pumped light source is also influenced by the size of the pulse acquired under the action of the buoyant force by the gas heated in the region of radiating plasma 2. The pulse acquired by the gas and the turbulence of convective flows are the less, the closer the region of radiating plasma 2 to the top chamber wall. Consequently, to ensure more stable output characteristics of the light source the top wall of chamber housing is positioned at a distance of no more than 5 mm from the region of radiating plasma 2.

The suppression of convective flow turbulence in the chamber and improvement of stability of the light source output characteristics is achieved by reducing the internal volume of the chamber. For this purpose, in the preferred embodiments of invention the chamber walls, as well as the focusing lens 13 and each window **6*b*** for outputting the beam of plasma radiation are positioned at a distance of no more than 5 mm from the region of radiating plasma.

Figure 5:
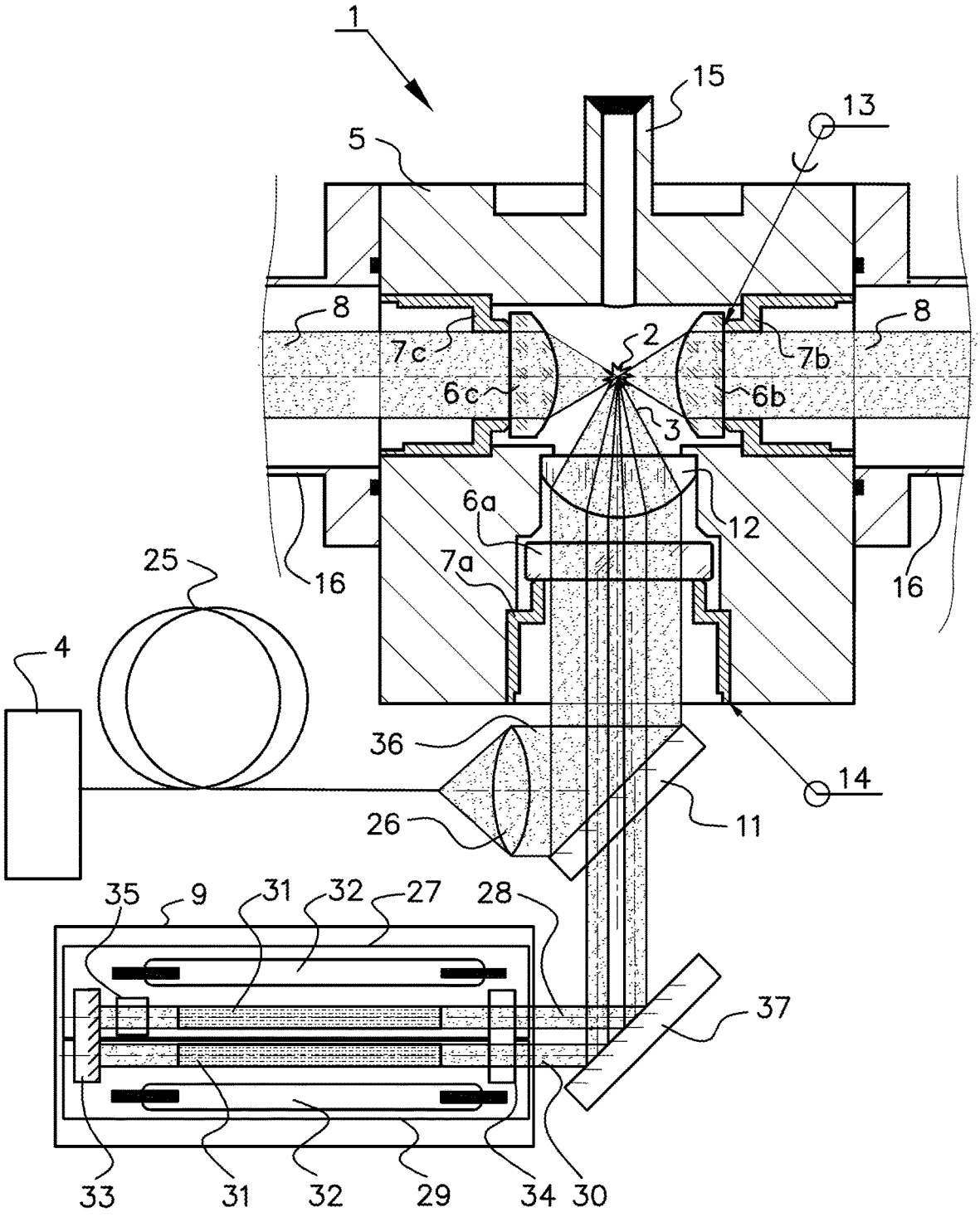

One more embodiment of the light source according to the present invention is schematically shown in FIG. 5. In this embodiment the chamber housing contains several windows **6*b*, 6*c* for outputting several beams of plasma radiation 8 from the chamber 1** which is required for certain applications of the light source.

Preferably, a high-efficiency diode near-infrared laser with the output of radiation to an optical fiber 25 is used as the CW laser 4. At the exit of optical fiber 25, the expanding laser beam is directed to the collimator 26, for example, in the form of a collecting lens. After the collimator 26 and the dichroic deflecting mirror 11 the expanded beam of CW laser is directed into the chamber 1. The optical system, window **6*a* and focusing lens 12 ensure sharp focusing of the beam 3** of CW laser required to achieve a high brightness of the light source.

In the embodiment of invention, FIG. 5, the starting ignition of plasma is provided by a solid-state laser system which contains a first laser 27 for generating the first laser beam 28 in Q-switching mode and a second laser 29 for generating the second laser beam 30 in free-running mode. Pulsed lasers with active elements 31 are equipped with optical pumping sources, for example, in the form of flash lamps 32 and preferably have the common mirrors 33, 34 of the cavity. The first laser 27 is equipped with a Q-switch 35.

Two pulsed laser beams 28, 30 are directed into the chamber and focused in the region intended for the sustenance of radiating plasma 2, FIG. 5. The first laser beam 28 is intended for starting plasma ignition or for optical breakdown. The second laser beam 30 is intended to create plasma, the volume and density of which are high enough for stationary sustenance of the region of radiating plasma 2 by the focused beam 3 of the CW laser.

Preferably, the CW laser wavelength $\lambda_{cw}$, is different from wavelengths $\lambda_1$, $\lambda_2$ of the first and second pulsed laser beams 28, 30. For example, the CW laser wavelength can be $\lambda_{cw}$=0.808 μm or 0.976 μm and the pulsed lasers can have a wavelength of radiation $\lambda_1=\lambda_2$=1.064 μm. This allows to use the dichroic mirror 11 for introducing the laser beam 36 of the CW laser 4 and the pulsed laser beams 28, 30. Additionally, a tilt mirror 37 can be used to transfer the pulsed laser beams 28, 30, FIG. 5.

This embodiment of invention provides for reliability of laser ignition and for user-friendliness of the light source. In contrast to sources using electrodes for starting plasma ignition, the possibility is achieved to optimize chamber geometry, reduce turbulence of convective flows in the chamber and minimize optical aberrations.

Otherwise, the device parts in this embodiment are the same as in the embodiments described above, have the same item numbers in FIG. 5, and their detailed description is omitted.

Generally, the proposed invention allows for expanding the radiation spectrum in the VUV spectral region and ensuring high brightness and stability of the laser-pumped plasma radiation source.

INDUSTRIAL APPLICABILITY

High-brightness high-stability laser-pumped light sources designed according to the present invention can be used in a variety of projection systems, for spectrochemical analysis, spectral microanalysis of bio objects in biology and medicine, microcapillary liquid chromatography, for inspection of the optical lithography process, for spectrophotometry and for other purposes.

What is claimed is:

1. A laser-pumped plasma light source, comprising: a chamber filled with a high-pressure gas, a means for plasma ignition, a region of radiating plasma sustained in the chamber by a focused beam of a continuous wave (CW) laser; at least one beam of plasma radiation exiting the chamber that contains a metal housing with a window for introducing into the chamber a beam of the CW laser and with at least one window for outputting a beam of plasma radiation from the chamber, wherein the beam of the CW laser is focused by a lens installed in the chamber between the window and the region of radiating plasma, the gas belongs to inert gases with a purity of at least 99.99% or is a mixture thereof, at least one window for outputting the beam of plasma radiation is made of crystalline magnesium fluoride ($MgF_2$), each window is located on an inner side of the chamber on an end of a sleeve closest to the region of radiating plasma, the sleeve located in a hole of the housing, each window is soldered to the sleeve by means of glass cement and the sleeve with the window soldered to it is welded to the hole of the metal housing.

2. The light source according to claim 1, wherein a surface of the end face of the sleeve and an adjacent surface of the $MgF_2$ window are substantially perpendicular to an optical axis of the $MgF_2$ crystal.

3. The light source according to claim 1, wherein each sleeve and the housing are made of a nickel-iron alloy with a coefficient of linear thermal expansion (CLTE) matched with the CLTE of the crystal magnesium fluoride in a direction perpendicular to an optical axis of the $MgF_2$ crystal.

4. The light source according to claim 1, wherein a short-wave boundary of a spectrum in the beam of plasma radiation is determined by a $MgF_2$ transmission boundary in a vacuum ultraviolet (VUV) region, being equal to 110 nm.

5. The light source according to claim 1, wherein a vacuum or gas environment, which does not absorb VUV radiation with a wavelength of 110 nm and more, is located outside the $MgF_2$ window.

6. The light source according to claim 5, wherein the chamber filled with the high-pressure gas is sealingly connected to an outside chamber with objects that are irradiated through the $MgF_2$ window by plasma radiation, said outside chamber is sealingly connected by means of a branch pipe made as a thermal bridge and equipped with a cooling radiator.

7. The light source according to claim 1, wherein the beam of plasma radiation is directed from the region of the radiating plasma to the $MgF_2$ window directly without reflections.

8. The light source according to claim 1, wherein all sleeves are axisymmetric sleeves with the windows soldered to them, the axisymmetric sleeves are welded to the housing made in one piece.

9. The light source according to claim 1, wherein the region of radiating plasma is located in a housing cavity formed by an intersection of at least two holes in each of which there is a sleeve with a window.

10. The light source according to claim 1, wherein at least one the sleeves is located in the hole of the housing, said sleeve has a variable outer diameter and the window is located at the end of the sleeve with a smaller outer diameter.

11. The light source according to claim 1, wherein the housing contains at least two housing parts with the windows, said housing parts are welded together after internal chamber parts are installed.

12. The light source according to claim 11, in the chamber of which at least one retroreflector is placed, for example, in ϕ b form of a spherical mirror centered in the region of radiating plasma.

13. The light source according to claim 1, wherein welds are outside the housing.

14. The light source according to claim 1, wherein the means for plasma ignition is a solid-state laser system generating two pulsed laser beams in Q-switching mode and in free-running mode, while in a continuous mode of operation a gas pressure in the chamber is around 50 bar or higher with a temperature of the chamber's inside surface of at least 600 K.

15. The light source according to claim 1, wherein the focused beam of the CW laser is directed into the chamber vertically upwards and an upper wall of the housing is located at a distance from the region of radiating plasma of no more than 5 mm.

16. The light source according to claim 1, wherein the lens focusing the beam of the CW laser and each window for outputting the beam of plasma radiation are located at a distance from the region of radiating plasma of no more than 5 mm.

17. The light source according to claim 1, wherein the window is a lens arranged for reducing aberrations which distort a path of rays of the beam of plasma radiation passing through the window, and for reducing the angular aperture of the beam of plasma radiation exiting the chamber.

18. The light source according to claim 1, wherein a direction of the beam of plasma radiation differs from a direction of the CW laser beam having passed through the region of radiating plasma.

19. The light source according to claim 1, wherein the chamber housing is designed as a rectangular prism, while the focused beam of the CW laser and the beams of plasma radiation have mutually orthogonal axes which intersect in the region of radiating plasma.

20. The light source according to claim 1, wherein the housing contains either a sealed gas inlet or a gas port designed to fill the chamber with gas and to control the pressure and composition of the gas in the chamber.

* * * * *